United States Patent [19]

Daniels et al.

[11] 3,982,830

[45] Sept. 28, 1976

[54] MAGNETIC BEAD CARRYOUT REDUCTION BY ALTERING THE DEVELOPER'S BIAS VOLTAGE

[75] Inventors: Raymond A. Daniels; Arthur H. Knight, both of Boulder, Colo.

[73] Assignee: International Business Machines Corporation, Armonk, N.Y.

[22] Filed: Dec. 6, 1974

[21] Appl. No.: 530,468

[52] U.S. Cl. ..... 355/3 DD; 118/637; 355/14

[51] Int. Cl.[2] ..... G03G 15/09

[58] Field of Search ..... 355/3 R, 3 DD, 16, 14, 355/3 DR, 3 BE; 117/17.5; 118/637, DIG. 24; 96/1 SD

[56] References Cited

UNITED STATES PATENTS

| | | | |
|---|---|---|---|
| 3,554,161 | 1/1971 | Blanchette | 118/8 |
| 3,588,242 | 6/1971 | Berlier et al. | 355/16 |
| 3,647,293 | 3/1972 | Queener | 355/15 |
| 3,706,489 | 12/1972 | Moxness et al. | 355/3 R |
| 3,728,016 | 4/1973 | Harbour et al. | 355/15 |
| 3,799,113 | 3/1974 | Whited | 118/637 |
| 3,850,662 | 11/1974 | Jahn | 117/17.5 |

*Primary Examiner*—L. T. Hix
*Assistant Examiner*—James LaBarre
*Attorney, Agent, or Firm*—Francis A. Sirr

[57] ABSTRACT

A magnetic brush developer wherein the bias voltage applied to the brush roll is altered, i.e., reduced, during the transit therepast of the photoconductor drum's seal, thereby reducing the number of magnetic carrier beads which are carried out of the developer on the surface and edges of the drum seal.

10 Claims, 3 Drawing Figures

MAGNETIC BEAD CARRYOUT REDUCTION BY ALTERING THE DEVELOPER'S BIAS VOLTAGE

BACKGROUND AND SUMMARY OF THE INVENTION

This invention relates to the field of electrophotography, i.e., xerography, and particularly to a means for reducing carryout of the carrier constituent of a developer mix by a photoconductor drum which includes a drum seal.

In the electrophotographic or electrostatic printing process a photoconductor, bearing a latent electrostatic image, is developed by applying a developer mix including electroscopic toner which is electrostatically carried by carrier beads. The developer includes means to agitate the toner and carrier so as to triboelectrically charge the carrier to a first polarity and the toner to the opposite polarity.

One form of photoconductor is a flexible sheet carried on the rigid surface of a drum. The photoconductor is stored in flexible strip form on supply and take-up rolls located within the drum's interior. The portion of the photoconductor extending between the two rolls encircles the drum and is active in the xerographic process. To change this active portion, a length of the photoconductor is advanced from the supply roll to the take-up roll. The drum's surface is formed with an axially extending opening or slit whereat the photoconductor enters and exits the drum's interior. This slit is closed by a seal strip to prevent developer mix, i.e., toner and carrier, from entering the interior of the drum. U.S. Pat. No. 3,588,242, issued to R. A. Berlier et al is an example of such a photoconductor.

While this drum seal is generally satisfactory, it has been found that developer mix carryout, and particularly carrier carryout by the drum seal as the seal leaves the developer, is improved by the present invention. Specifically, the present invention contemplates changing the bias voltage on the developer's development electrode to create an electrical field which operates to reduce the force with which the carrier is presented the drum seal while the drum seal is within the developer.

The prior art teaches diverse reasons for changing a developer's bias voltage. In one instance the electric field between a paper supported photoconductor and a magnetic brush developer is adjusted as a function of the conductivity of the photoconductor to repell unwanted toner from the photoconductor's background area.

Other prior art teaches that charged toner can be transferred from one member to another. For example, the reversal of a cleaning member's bias voltage operates to effect toner removal from the cleaning member to a drum-carried serrated plate during passage of the plate past the cleaning member.

Yet other prior art teaches the concept of selectively changing the bias applied to a developer to selectively develop or clean the photoconductor.

The preferred embodiment of the present invention relates to a magnetic brush developer and to the concept of altering, i.e., reducing, the brush roll's bias voltage in synchronism with passage of the photoconductor drum seal adjacent a developing station, to thereby reduce the number of magnetic beads which are carried out of the developing station by the drum seal.

While the present invention will be described in the environment of its preferred embodiment, namely a magnetic brush developer, its use is not restricted thereto, but rather the present invention is believed to have utility with any developer having a development electrode or its equivalent.

More specifically, and only by way of a specific example, the magnetic brush developer may be used to supply negatively charged carrier beads and positively charged toner particles to the incrementing drum photoconductor's negatively charge latent image. Toner is thus electrostatically applied to the latent image to form a visible image. The physical discontinuity represented on the drum's surface by the drum seal operates to physically pick up negative carrier beads. The magnetic brush roll is biased negative when the photoconductor is passing the brush roll, to function as a development electrode, and is biased less negative, i.e., substantially to zero potential, or perhaps positive, when the drum seal is passing the brush roll, to thereby reduce the force with which the negative carrier beads are presented to the drum seal.

The foregoing and other features and advantages of the invention will be apparent from the following more particular description of a preferred embodiment of the invention, as illustrated in the accompanying drawing.

DESCRIPTION OF THE PREFERRED EMBODIMENT

Figure 1:
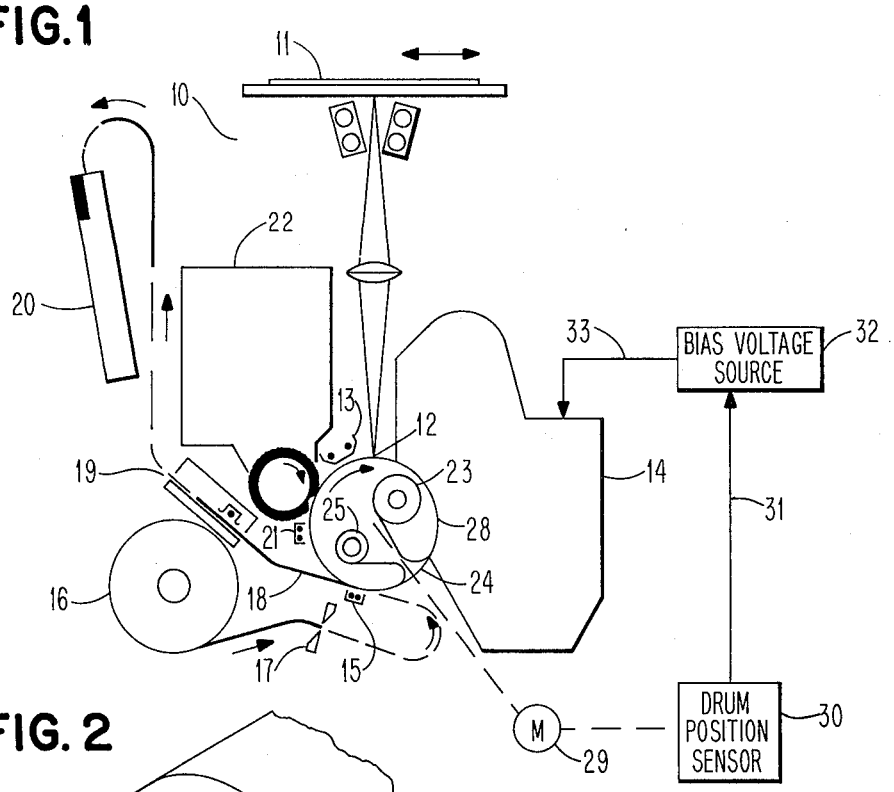
FIG. 1 is a schematic side view of a xerographic copying machine employing the present invention.

FIG. 1 is a schematic side view of a xerographic copying machine employing the present invention. The exact configuration of the copying machine disclosed in FIG. 1 is not a limitation upon the present invention since it is contemplated that various electrophotographic machine configurations can utilize the present invention. The apparatus of FIG. 1 includes a moving document imaging station 10 whereat an original document 11 is imaged onto a drum type photoconductor 28 at an elongated footprint or slit 12.

Prior to being imaged at 12 the photoconductor is subjected to an electrostatic charge at charging station 13. Again only by way of example, charging station 13 lays down a uniform negative charge of approximately 800 volts on the surface of the photoconductor. At imaging station 12 the background image area is reduced to the range of approximately −100 to −200 volts, whereas the electrostatic latent image thereafter carried by the photoconductor comprises a much higher negative voltage, more nearly equal that of the negative 800 volts supplied at the charging station.

The electrostatic latent image is next subjected to the development mix at developing apparatus 14. Developing apparatus 14 includes a developing mix comprising triboelectrically charged carrier beads having toner particles electrostatically adhered to the surface thereof. Carrier beads are much larger than the toner particles. Toner particles generally have an average diameter between 1 and 30 microns, whereas the carrier beads may have an average diameter of from 50 to 1000 microns. With the present exemplary system, since the electrostatic image is negative, the carrier beads are also negative and the toner particles are charged positive. The developer unit operates to physically engage the photoconductor surface with the developer mix such that toner is released from the carrier beads and deposited to form a visible image on the photoconductor, corresponding in outline to that of the electrostatic image.

The toned photoconductor next passes to transfer station 15 whereat the major portion of the toner is electrostatically transferred to a sheet of paper which has been cut from paper supply roll 16 by cutter 17. The thusly toned paper sheet 18 then passes to fuser 19 whereat the toner is fixed to the paper, whereupon the paper is deposited in exit pocket 20.

After the photoconductor leaves the area of transfer station 15, the photoconductor and the residual toner particles remaining thereon are subjected to a positive charge at preclean corona unit 21. The residual toner is thereafter cleaned from the photoconductor by brush cleaner 22.

The photoconductor disclosed in FIG. 1 comprises a flexible sheet which is carried on the rigid surface of a drum. The photoconductor is stored in flexible strip form on supply roll 23. The photoconductor extends from supply roll 23, out of drum slot 24, about the major circumferential portion of the drum, and returns through the drum slot to take-up roll 25. The portion of the photoconductor extending between the two rolls, and encircling the drum is active in the xerographic process. In order to change this active portion, a length of the photoconductor is advanced from the supply roll to the take-up roll. The drum's surface continuity is broken by the axially extending opening or slit 24 whereat the photoconductor enters and exits the drum's interior. This slit is closed by a seal member to prevent developer mix from entering the interior of the drum.

Figure 2:
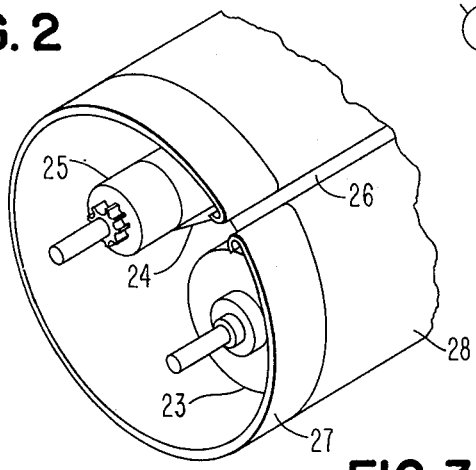
FIG. 2 is an exploded and perspective view showing the incrementing drum photoconductor and its drum seal, as used in FIG. 1.

With reference to FIG. 2, this figure is an exploded and perspective view showing the incrementing drum photoconductor and its drum seal 26. Reference may be had to above-mentioned U.S. Pat. No. 3,588,242 for a more complete description of this incrementing drum structure. FIG. 2 discloses the electrically conductive metal drum 27 about which flexible photoconductor 28 is wrapped. This metal photoconductor backing is connected to electrical ground potential. Seal 26 is formed of electrically conductive material and is connected to ground as is drum surface 27.

While the exemplary incremental drum structure shown in FIG. 2 shows but one drum seal, within the teachings of the present invention such an incrementing drum can be provided with a multiplicity of photoconductor segments and seals, as shown for example in the IBM TECHNICAL DISCLOSURE BULLETIN of September 1972, at page 1261.

Referring again to FIG. 1, rotation of the drum, in a clockwise direction, is accomplished by motor 29. In addition to driving the drum, this motor drives a drum position sensor 30 whose output 31 is operable to control bias voltage source 32. Output 33 of this bias voltage source is connected to provide a development electrode biasing field for developer 14 and is additionally controlled to reduce the bias voltage applied developer 14 when slot 24 and/or drum seal 26 are in position to cooperate with developer 14. Specifically, drum position sensor 30 may comprise, for example, a motor driven cam, or alternatively, a magnetic emitter which emits a control pulse to bias voltage source 32 when slit 24 and/or drum seal 26 are within developer 14. Such a magnetic emitter is described in the IBM TECHNICAL DISCLOSURE BULLETIN of September 1972, at page 1254.

Figure 3:
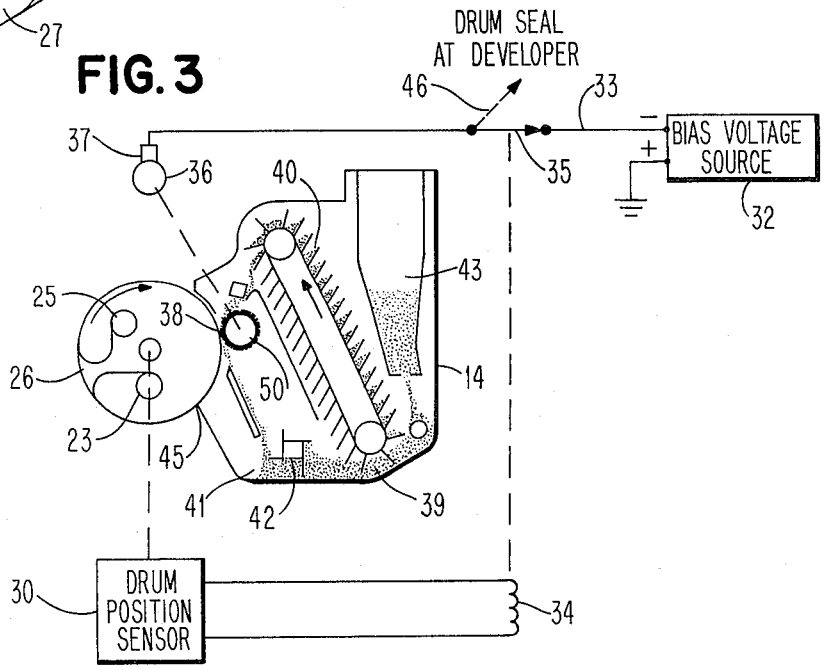
FIG. 3 is a schematic view of one form of magnetic brush developer and switching apparatus which, in accordance with the present invention, reduces the brush roll's bias voltage from a negative potential to substantially zero when the drum seal is at the developer.

With reference to FIG. 3, this figure is a schematic view of one form of magnetic brush developer and switching apparatus which, in accordance with the present invention, reduces the brush roll's bias voltage from a negative value to substantially zero when the drum seal is at the position of developer 14. In this arrangement, drum position sensor 30 is shown controlling a relay 34 whose switch 35 is connected in circuit with the output 33 of bias voltage source 32. The negative terminal of source 32 is connected to magnetic brush roll 50 by way of switch 35, brush 37 and slip ring 36. As is well known to those of skill in the art, brush roll 50 comprises a nonmagnetic, electrically conductive metal cylinder having magnets disposed therein such that an upstanding brush of magnetic carrier beads, overcoated with toner particles, is presented to development zone 38 adjacent the photoconductor drum. The magnetic field provided by the magnets within brush roll 50 operates to physically force the magnetic carrier against the photoconductor, causing the toner to be dislodged therefrom and to electrostatically adhere to the photoconductor's electrostatic latent image. Toner enriched carrier is elevated from sump 39 and deposited onto the top surface of brush roll 50 by conveying apparatus 40. Toner depleted carrier returns to the sump at area 41 where it is mixed with additional toner by agitating mechanism 42. Additional toner is supplied from dispenser 43.

The negative bias voltage which is applied to brush roll 50 from source 32 has an exemplary value in the range of approximately 300 to 375 volts negative. Since the photoconductor's background area is charged to the range of approximately 100 to 200 volts negative, development electrode effect of brush roll 50 operates to minimize positive toner deposit on the photoconductor's background area. That is, the positively charged toner particles are subjected to a repelling field tending to repel the toner from the photoconductor's background area. However, in the photoconductor's image area, whereat the electrostatic latent image is approximately 800 volts negative, the electrical field is reversed and the toner tends to adhere to the photoconductor's latent image.

When drum seal 26 reaches development zone 28, the magnetic carrier particles are forced thereagainst by the magnetic brush's magnetic field. As a result, the small carrier particles tend to mechanically adhere to this discontinuity formed in the surface of the photoconductor drum. In order to minimize developer mix carryout, as the drum seal leaves the portion 45 of developer 14, drum position sensor 30 operates to move switch blade 35 to its dotted line position 46. As a result, the bias voltage applied to brush roll 50 is reduced. Since the negative voltage on the carrier and the negative voltage previously applied to brush roll 50 produced a repelling field which operated to increase the force with which the development mix was forced against the drum surface, the opening of switch 35 has the effect of reducing the total force tending to pack carrier beads into the drum's surface discontinuity, leaving only the magnetic field force. As a result, bead carryout, as drum seal 26 leaves developer 14 at portion 45, is considerably reduced.

The operation of drum position sensor 30 is such that operation of switch 35 occurs only during that time in which drum seal 36 resides within developer 14 and particularly within developing zone 38.

While FIG. 3 discloses a particular form of magnetic brush developer, the present invention is not to be restricted thereto. Other magnetic brush configurations, for example the type shown in the IBM TECHNICAL DISCLOSURE BULLETIN of September 1972, at pages 1251 and 1252, may likewise be used in place thereof.

In addition, while the structure of FIG. 3 specifically discloses that the bias voltage applied to brush roll 50 is reduced from a relatively high negative value to substantially zero upon the opening of switch 35, the present invention contemplates that switch 35, when in dotted line position 46, may in fact apply a positive bias voltage to brush roll 50. This positive voltage must be limited in magnitude since while the positive voltage tends to attract the negatively charged carrier from the crevices in and about the drum seal, this same positive voltage forms a repelling field which tends to cause the positively charged toner to adhere to the photoconductor adjacent the drum seal. In a preferred embodiment, the bias voltage applied to brush roll 50 was reduced to approximately 115 volts negative upon the opening of switch 35. Reducing this voltage to zero, or to a positive polarity voltage, may result in excessive toner deposit on that area of the drum, with attendant toner waste and possible overloading of the cleaning station.

While the invention has been particularly shown and described with reference to a preferred embodiment thereof, it will be understood by those skilled in the art that various changes in form and details may be made therein without departing from the spirit and scope of the invention.

What is claimed is:

1. An electrophotographic machine, comprising:

a rotatable drum having at least one axial slot in the surface thereof, an incrementing photoconductor contained within said drum, having a portion thereof emanating from a drum slot to encircle a portion of said drum, and returning to the interior of said drum through a drum slot, means operable during drum rotation to charge said photoconductor portion to one polarity, illumination means thereafter operable during drum rotation to selectively discharge said photoconductor portion to provide a latent electrostatic image thereon, and an electrophotographic development unit, including:

a developer mix comprising carrier charged to said one polarity and toner charged to an opposite polarity, development electrode means, bias voltage applying means for applying a voltage of said one polarity to said development electrode means to create a development electrode effect between said development electrode and said photoconductor portion; and switching means responsive to the drum position operable to change the voltage on said development electrode to reduce the force with which said carrier is presented to a drum slot as it passes said development electrode.

2. The electrophotographic machine defined in claim 1 wherein said development electrode means is a magnetic brush roll.

3. The electrophotographic machine defined in claim 2 wherein said bias voltage means is operable to apply said voltage of said one polarity to said brush roll when said photoconductor portion rotates past said brush roll, and wherein said switching means is operable to change the voltage on said brush roll from said one polarity in the direction of said opposite polarity when a drum slot passes said brush roll.

4. The electrophotographic machine defined in claim 3 wherein said switching means is operable to disconnect said bias voltage source from said brush roll when a drum slot passes said brush roll.

5. An electrophotographic machine, comprising:

a rotatable drum having at least one sealed axial slot in the surface thereof, an incrementing photoconductor contained within said drum, having a portion thereof emanating from a drum slot to encircle a portion of said drum, and returning to the interior of said drum through a drum slot, means operable during drum rotation to charge said photoconductor portion to one polarity, illumination means thereafter operable during drum rotation to selectively discharge said photoconductor portion to provide a latent electrostatic image thereon, and a magnetic brush developer unit, including:

a developer mix comprising a magnetic carrier charged to said one polarity and toner charged to an opposite polarity, bias voltage source means for applying a desired voltage level of said one polarity to the magnetic brush developer to create a development electrode effect between the developer and said photoconductor portion; and switching means responsive to the drum position for changing the voltage on the magnetic brush developer to reduce the force with which carrier is presented to a drum seal as it moves therepast.

6. The electrophotographic machine defined in claim 5 wherein said developer unit includes a nonmagnetic electrically conductive brush roll for presenting said developer mix to the drum surface, and wherein said bias source means applies said voltage of said one polarity to said brush roll.

7. The electrophotographic machine defined in claim 6 wherein said switching means is operable to change the voltage on said brush roll from said one polarity in the direction of said opposite polarity when a drum seal passes said brush roll.

8. The electrophotographic apparatus defined in claim 7 wherein said switching means is operable to disconnect said bias source means from said brush roll when a drum seal passes said brush roll.

9. An electrostatic reproduction apparatus comprising:

a photoconductor mounted for movement and having a conductive backing plate and having its surface continuity broken by at least one discontinuity extending generally transverse to the direction of photoconductor movement;

drive means for moving said photoconductor past a plurality of processing stations including a charging station and an imaging station for creating a latent electrostatic image of a first polarity on said photoconductivity, and a developing station having a development electrode and a bias voltage source of said first polarity connected between said development electrode and said conductive backing plate, said developing station operating to apply a developing mix of carrier charged to said first polarity and toner charged to an opposite polarity to said latent electrostatic image; and means responsive to the position of said photoconductor when said discontinuity is at said developing station to control said bias voltage source in a manner to change the voltage applied to said development electrode from said one polarity in the direction of said opposite polarity, thereby reducing the force with which said developing mix is applied to said discontinuity as it passes said development electrode.

10. An electrostatic reproduction apparatus as defined in claim 9 wherein said carrier is magnetic, wherein said developing station includes a magnetic brush developer having a brush roll development electrode for presenting said developing mix to said photoconductor, and wherein said means responsive to the position of said photoconductor includes means to disconnect said voltage source from said brush roll when said discontinuity is in a position to cooperate with said brush roll.

* * * * *